US006160473A

United States Patent [19]

Gruhn

[11] Patent Number: 6,160,473

[45] Date of Patent: Dec. 12, 2000

[54] CONTACT ASSEMBLY FOR SEMICONDUCTOR RESISTORS SUCH AS POSISTORS

[75] Inventor: Bernd Gruhn, Lieboch, Germany

[73] Assignee: Siemens Matsushita Components GmbH & Co. KG, Munich, Germany

[21] Appl. No.: 09/242,785

[22] PCT Filed: Sep. 18, 1997

[86] PCT No.: PCT/DE97/02118

§ 371 Date: Feb. 23, 1999

§ 102(e) Date: Feb. 23, 1999

[87] PCT Pub. No.: WO98/12713

PCT Pub. Date: Mar. 26, 1998

[30] Foreign Application Priority Data

Sep. 20, 1996 [DE] Germany ..... 196 38 631

[51] Int. Cl.[7] ..... H01C 7/10

[52] U.S. Cl. ..... 338/22 R; 338/221; 338/234

[58] Field of Search ..... 338/22 R, 234, 338/235, 236, 221

[56] References Cited

U.S. PATENT DOCUMENTS 4,431,983 2/1984 Rodriguez .

4,924,204 5/1990 Uchida ..... 338/22 R 5,117,089 5/1992 Honkomp et al. ..... 219/201

FOREIGN PATENT DOCUMENTS 0 618 594 A1 5/1994 European Pat. Off. .

0 724 143 A1 7/1996 European Pat. Off. .

38 39 868 A1 8/1989 Germany .

OTHER PUBLICATIONS

Patent Abstracts of Japan, vol. 16, No. 294, (E–1225), Jun. 29, 1992 & JP 04 078103 dated Mar. 12, 1992.

Patent Abstracts of Japan, vol. 15, No. 250, (E–1082), Jun. 26, 1991 & JP 03 078455 dated Apr. 3, 1991.

Patent Abstracts of Japan, vol. 16, No. 294, (E–1225) Jun. 29, 1992 & JP 04 078104 dated Mar. 12, 1992.

*Primary Examiner*—Karl D. Easthom

*Attorney, Agent, or Firm*—Hill & Simpson

[57] ABSTRACT

In a contact assembly for semiconductor resistors, contact elements (5*a*, 5*b*) are designed asymmetrically in such a way that, on mutually opposite side faces of an electrical component (3), they bear on it while being mutually offset.

2 Claims, 1 Drawing Sheet

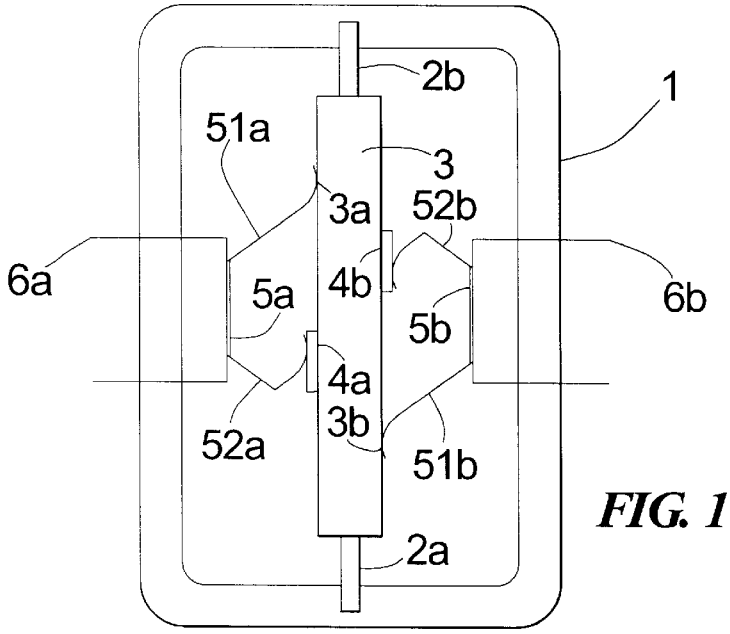
FIG. 1
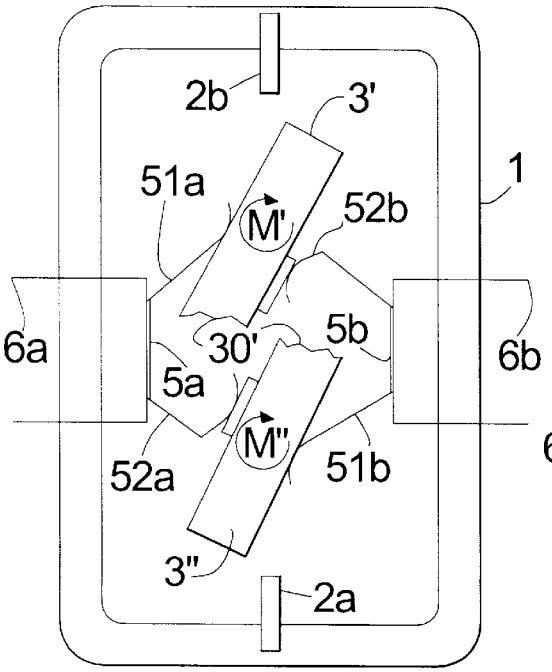
FIG. 2
FIG. 3
(PRIOR ART)
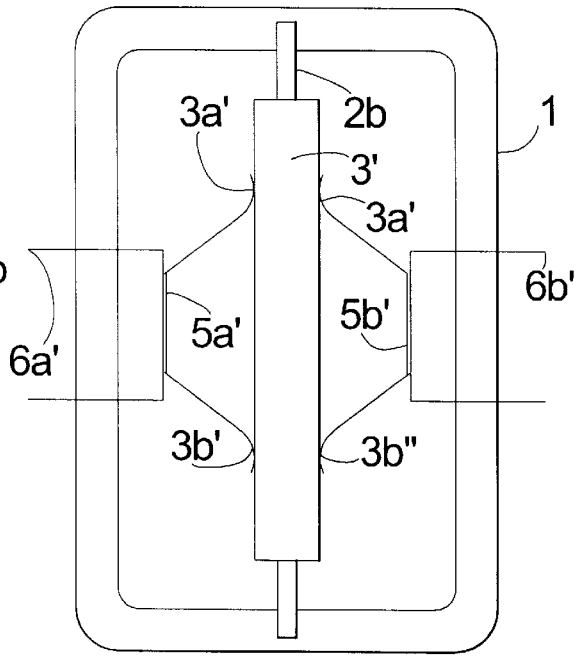

CONTACT ASSEMBLY FOR SEMICONDUCTOR RESISTORS SUCH AS POSISTORS

BACKGROUND OF THE INVENTION

The invention relates to a contact assembly with a PTC thermistor.

For example, in the case of cooling units of refrigerators, co-called motor start-up PTC thermistors are connected in front of their electric motors, the drive shaft of which connects directly with the cooling compressor. In each start-up phase, of the electric motor, the resistance of the PTC thermistor increases from a few ohms, for example 10 Ω in the cold state, in a very short time, often in a few seconds measured from the cold state, to very high resistance values which, for example, are of the order of 20,000 Ω.

Because of the very great increase in the resistance value of the PTC thermistor which takes place in a short time, it is always heated very strongly. The effect of these increases in temperature, repeated frequently in a comparatively short time, in particular in the case of PTC thermistors connected in front of cooling units, is that under unfavourable ambient conditions, for example oil or oily atmosphere, they are subjected to thermally induced ageing, leading to the occasional formation of cracks in the PTC thermistors, which may lead to fractures and therefore to destruction of the PTC thermistor.

In FIG. 3, a motor start-up PTC thermistor 3' of this type is held in a housing 1 by means of supports 2*a*, 2*b*. Electrical connections are generally provided on opposite sides of the PTC thermistor 3', in such a way that the current is preferably fed via spring contacts 5*a'* and 5*b'* which press against the side faces of the PTC thermistor 3' at points 3*a'*, 3*a"* and 3*b'*, 3*b"* which are exactly opposite one another. Electrical contact between the PTC thermistor 3' and the connections 6*a'* and 6*b'* is made in this way.

As described above, current is preferably supplied in the case of PTC thermistors of this type via spring contacts which bear with some pressure on the PTC thermistor. This entails the risk, for example, that if the PTC thermistor fractures then the current-carrying spring contacts can come into contact with one another, leading to a short-circuit, or that fairly sizeable fragments of a broken PTC thermistor may still be in contact with one another and currents measuring several amperes may flow through the fragments which are in contact with one another.

European reference EP 0 618 594 A1 discloses a contact assembly with PTC resistor. Given this arrangement, there is the risk that, even after a fracture of the PTC resistor, fragments will remain clamped between contact springs and prestressed parts, as a result whereof the flow of current in the fragments is not interrupted, so that it is entirely possible to start a smouldering fire which can under certain circumstances set the refrigerator on fire.

SUMMARY OF THE INVENTION

The object of the invention is therefore to improve a contact assembly with a PTC thermistor to the extent that the highest possible degree of safety is ensured.

In the case of the contact assembly according to the invention with a PTC thermistor, in particular for cooling units of refrigerators, its contact elements are asymmetrically designed so that, on opposite side faces of an electrical component, they bear on it while being mutually offset.

According to the invention, forces are therefore exerted on the PTC resistor via the contact elements at the mutually offset contact points.

This has the advantageous effect that, in the event of the PTC resistor fracturing, the contact elements bearing on it cannot come into contact with one another, and a short-circuit cannot therefore result.

Trials under laboratory conditions have demonstrated that PTC thermistors under thermal overload conditions are not susceptible to simple transverse fractures, but instead break into a large number of pieces. If, for example, current is fed to a motor start-up PTC thermistor via contact elements which bear on it, then use of the contact assembly according to the invention virtually rules out the possibility of a short-circuit.

However, as already referred to above, leakage currents could, for example, also arise if individual fragments of the broken PTC thermistor are still in contact with one another, with the effect that the thermistor will heat up correspondingly and again lead to smouldering fires, or even full outbreak of fire in the worst case.

According to the invention, in order to resolve the problem presented above, the contact elements are preferably formed as integral elements comprising contact springs and prestressed parts. By means of this, corresponding forces are exerted on the PTC resistor not only at the points where the contact springs bear on it, but also at the points where the prestressed parts bear on the PTC resistor.

In this case, because of the asymmetric design of the contact elements according to the invention, the prestressed parts each exert a force towards the PTC resistor at respective points which are arranged with an offset relative to the contact points on the opposite side, at which a force is exerted by means of the contact springs.

Since opposing forces thus act on the PTC resistor at mutually offset points, if cracks occur then the PTC resistor will readily break into two fragments in such a way that the two fragments of the broken component are no longer in contact with one another. Currents, and in particular leakage currents, can no longer arise, and the onset of smouldering fires or full fires is thereby prevented.

According to the invention, a moment is therefore exerted on each of the fragments when the PTC resistor fractures. In the event of the component fracturing or breaking into individual pieces, this ensures that, on the one hand, there can be no short-circuit between the contact springs and, on the other hand, there also cannot be any leakage currents between the component fragments, since in the contact assembly according to the invention the individual fragments are separated from one another even further by the interaction of the asymmetric contact elements and the prestressed parts.

In order to improve safety yet further, the points on the PTC thermistor at which the prestressed parts bear are made electrically insulated.

Using the contact assembly according to the invention with a PTC thermistor has the particular effect of quite substantially improving safety when PTC thermistors of this type are used in refrigerator units.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

FIG. 1 shows a schematic view of one embodiment of a contact assembly according to the invention, with reference to the example of a PTC thermistor provided in a motor start-up device;

FIG. 2 shows the contact assembly in FIG. 1 after the PTC thermistor has fractured; and FIG. 3 shows a schematic view of a known contact assembly for a PTC thermistor provided in a motor start-up device.

DESCRIPTION OF THE PREFERRED EMBODIMENTS

FIG. 1 represents a schematic view of a contact assembly with reference to a PTC thermistor 3 provided in a motor start-up device. The PTC thermistor 3 is held via retaining parts 2*a* and 2*b* in a housing 1. Furthermore, two contact supports 6*a* and 6*b*, for example of U-shape, are provided in the housing 1.

A contact element 5*a* or 5*b* respectively, is in each case attached to the contact supports 6*a* and 6*b*. Each of the contact elements 5*a* and 5*b* has two resilient regions 51*a* and 52*a* or 51*b* and 52*b*, respectively, one resilient region 51*a* or 51*b* respectively, serving as a contact spring and the other resilient region 52*a* or 52*b*, respectively, serving as a prestressed part. Furthermore, according to the invention, the contact elements 5*a* and 5*b*, having the contact springs 51*a*, 51*b* and prestressed parts 52*a*, 52*b*, are each designed integrally.

The two contact elements 5*a* and 5*b* are prestressed in such a way that forces are exerted on the PTC thermistor 3 by each of the resilient regions 51*a*, 52*a* or 51*b*, 52*b*, respectively, that is to say the contact springs 51*a*, 51*b* or the prestressed parts 52*a*, 52*b* respectively. The forces exerted by 51*a*, 51*b* act on the PTC thermistor 3 at contact points 3*a*, 3*b*. In the embodiment represented in FIG. 1, the forces exerted by the prestressed parts 52*a* and 52*b* act on the PTC thermistor 3 at insulated points 4*a* or 4*b*, respectively. In this case, the points 4*a* or 4*b*, respectively are, for example, electrically insulated by mica.

FIG. 2 represents the contact assembly portrayed in FIG. 1 after the PTC thermistor 3 has fractured. If, for example, the PTC thermistor 3 breaks along fracture faces 30', the two PTC thermitor fragments 3' and 3" are, for example, rotated into the position represented in FIG. 2. A corresponding rotation is brought about in that the PTC thermistor fragments 3' and 3" respectively have forces exerted on them, by the resilient regions 51*a* and 52*b* or 52*a* and 51*b*, respectively, at bearing points 3*a*, 4*b* and 3*b*, 4*a* which are offset relative to one another. Moments M' or M", respectively, therefore act on the PTC thermistor fragments 3' and 3" in the clockwise direction, which is indicated by the arrows with which the references M' and M" are provided.

Furthermore, the retaining parts 2*a* and 2*b*, which serve to support the PTC thermistor 3, are configured in such a way that they also fracture if the PTC thermistor 3 fractures, so as not to hinder rotation of the two PTC thermistor fragments 3' and 3".

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A contact assembly for contacting a PTC resistor, comprising:

a PTC resistor;

contact elements that are asymmetrically structured, so that the contact elements lie against the PTC resistor offset relative to one another at mutually opposite lateral surfaces of the PTC resistor;

the contact elements being integrally formed as one-piece elements of contact springs and prestressed parts, forces acting on the PTC resistor via the contact springs at mutually offset contact locations, the prestressed parts respectively exerting a force in the direction of the PTC resistor at respective locations that are arranged offset relative to the contact locations at the opposite side at which the force is exerted by the contact springs; and the respective locations at the PTC resistor against which the prestressed parts exert a force being electrically insulated.

2. A contact assembly for use in a coding unit of a refrigerator, comprising:

a PTC resistor;

at least first and second contact elements that lie against the PTC resistor offset relative to one another at mutually opposite lateral surfaces of the PTC resistor;

the contact elements integrally formed as one-piece elements of contact springs and prestressed parts, the contact springs applying forces on the PTC resistor at mutually offset contact locations;

the prestressed parts respectively exerting forces on the PTC resistor at respective locations that are arranged offset relative to the contact locations at opposite sides at which forces are exerted by the contact springs; and the respective locations at the PTC resistor against which the prestressed parts exert a force being electrically insulated.

* * * * *